US010738776B2

(12) United States Patent
Onimatsu et al.

(10) Patent No.: US 10,738,776 B2
(45) Date of Patent: Aug. 11, 2020

(54) GEAR PUMP DEVICE FOR RUBBER EXTRUSION

(71) Applicants: SUMITOMO RUBBER INDUSTRIES, LTD., Kobe-shi, Hyogo (JP); NAKATA ENGINEERING CO., LTD., Kobe-shi Hyogo (JP)

(72) Inventors: Hiroyuki Onimatsu, Kobe (JP); Nozomu Nishioka, Kobe (JP); Hiroshi Ihara, Kobe (JP); Noboru Ishihara, Kobe (JP); Naoyasu Nakao, Kobe (JP)

(73) Assignees: SUMITOMO RUBBER INDUSTRIES, LTD., Kobe-shi, Hyogo (JP); NAKATA ENGINEERING CO., LTD., Kobe-shi, Hyogo (JP)

( * ) Notice: Subject to any disclaimer, the term of this patent is extended or adjusted under 35 U.S.C. 154(b) by 288 days.

(21) Appl. No.: 15/770,639

(22) PCT Filed: Oct. 3, 2016

(86) PCT No.: PCT/JP2016/079227
§ 371 (c)(1),
(2) Date: Apr. 24, 2018

(87) PCT Pub. No.: WO2017/077798
PCT Pub. Date: May 11, 2017

(65) Prior Publication Data

US 2018/0320686 A1 Nov. 8, 2018

(30) Foreign Application Priority Data

Nov. 5, 2015 (JP) ..... 2015-217795

(51) Int. Cl.
*F04C 2/18* (2006.01)
*F04C 13/00* (2006.01)
(Continued)

(52) U.S. Cl.
CPC ..... *F04C 2/18* (2013.01); *F01C 19/005* (2013.01); *F04C 2/16* (2013.01); *F04C 13/002* (2013.01);
(Continued)

(58) Field of Classification Search
CPC .. F01C 19/005; F04C 13/002; F04C 15/0015; F04C 15/0019; F04C 15/0038; F04C 2240/56; F04C 2/18
See application file for complete search history.

(56) References Cited

U.S. PATENT DOCUMENTS 3,481,275 A 12/1969 Gelin
8,821,140 B2 * 9/2014 Paval ..... F04C 2/16 277/500
(Continued)

FOREIGN PATENT DOCUMENTS

JP 51-2 Y1 1/1976
JP 53-109205 A 9/1978
(Continued)

OTHER PUBLICATIONS

International Search Report, issued in PCT/JP2016/079227, PCT/ISA/210, dated Dec. 27, 2016.
(Continued)

*Primary Examiner* — Mary Davis
(74) *Attorney, Agent, or Firm* — Birch, Stewart, Kolasch & Birch LLP

(57) ABSTRACT

In a gear pump device for rubber extrusion, prolongation of the maintenance intervals is intended by preventing rubber scorch occurring at the gear support-shaft portion. It has a bushing ring 5 inserted in a gear-housing bore 3 of a housing 4. The bushing ring 5 rotatably supports a support-shaft portion 7 of a gear 2 accommodated in the gear-housing bore 3. The bushing ring 5 has a bearing 15 and a sealing means
(Continued)

16 built-in. The sealing means 16 includes a seal ring 22 of which cross section is ]-shaped and which has a first lip portion 22*i* contacting with the outer peripheral surface of the support-shaft portion 7, a second lip portion 22*o* disposed outside thereof in the radial direction, and a side wall portion 22*m* connecting between outer ends in the axial direction, of the first and second lip portions 22*i*, 22*o*.

3 Claims, 6 Drawing Sheets

(51) Int. Cl.
*F01C 19/00* (2006.01)
*F04C 15/00* (2006.01)
*F04C 2/16* (2006.01)

(52) U.S. Cl.
CPC ..... *F04C 15/0015* (2013.01); *F04C 15/0038* (2013.01); *F04C 15/0019* (2013.01); *F04C 2240/56* (2013.01)

(56) References Cited

U.S. PATENT DOCUMENTS

| | | | |
|---|---|---|---|
| 2010/0196186 | A1 | 8/2010 | Helbing et al. |
| 2013/0259729 | A1 | 10/2013 | Alexander et al. |

FOREIGN PATENT DOCUMENTS

| | | | |
|---|---|---|---|
| JP | 10-131870 | A | 5/1998 |
| JP | 2012-76550 | A | 4/2012 |
| WO | WO 2008/135326 | A1 | 11/2008 |

OTHER PUBLICATIONS

Written Opinion of the International Searching Authority, issued in PCT/JP2016/079227, PCT/ISA/237, dated Dec. 27, 2016.
Extended European Search Report for European Application No. 16861866.8, dated May 27, 2019.

* cited by examiner

GEAR PUMP DEVICE FOR RUBBER EXTRUSION

TECHNICAL FIELD

The present invention relates to a gear pump device for rubber extrusion capable of preventing rubber scorch from occurring at a support-shaft portion for a long term.

BACKGROUND OF THE ART

As a gear pump device for rubber extrusion, for example, there have been proposed one described in the following Patent Document 1. This proposed gear pump device has, as shown in FIG. 6, a pair of gears (a, a) engaged with each other, a housing c having a gear-housing bore b for housing a pair of the gears (a, a), and a side plate d inserted in the gear-housing bore b.

In a supporting hole of each side plate d, a ceramic cylindrical bushing e is disposed. Then, a support-shaft portion a1 of each gear (a) is pivotally supported via the bushing e.

This device is configured so that a portion of rubber within a pump chamber b1 defined between the side plates d, d is circulated, toward the pump chamber b1, through a gap between an inner peripheral surface of the bushing e and an outer peripheral surface of the support-shaft portion a1. In this case, as the rubber flows in the direction of the circulation within the gap, the rubber scorch within the gap can be reduced to some degree. But it is not enough, and maintenance is necessary on a regular basis (for example, every two or three months).

Further, depending on the kind of the rubber, the rubber scorch is caused early, and the torque which is increased thereby may possibly lead the drive system to fail.

PRIOR ART DOCUMENT

Patent Document

Patent Document 1: Japanese Patent Application Publication No. H10-131870

SUMMARY OF THE INVENTION

Problems to be Solved by the Invention

In the present invention, therefore, a problem is to provide a gear pump device for rubber extrusion, in which rubber scorch at the support-shaft portion can be prevented for a long term, aiming at prolongation of maintenance intervals and prevention of failure of the drive system caused by the increased torque.

Means for Solving the Problem

The present invention is a gear pump device for rubber extrusion, which has a pair of gears engaged with each other, a housing having a gear-housing bore housing a pair of the gears, and a bushing ring inserted in the gear-housing bore at end portions thereof in the axial direction, and which is characterized in that the gear has a gear portion and a shaft portion concentrically extending from the gear portion toward both sides in the axial direction, the bushing ring has a bearing and a sealing means built-in, the bearing rotatably supporting the support-shaft portion, and the sealing means disposed inward of the bearing in the axial direction and sealing between it and the outer peripheral surface of the support-shaft portion, and the sealing means includes a sealing ring which is formed from a rubber elastic body whose cross section is ]-shaped and which has a cylindrical first lip portion contacting with the outer peripheral surface of the support-shaft portion, a cylindrical second lip portion disposed outside thereof in the radial direction, and a side wall portion connecting between axially outer ends of the first and second lip portions.

In the gear pump device for rubber extrusion according to the present invention, it is preferable that the bushing ring has a ring-shaped bushing base portion concentrically inserted in the gear-housing bore, and the inner peripheral surface of the bushing base portion has a circumferential-groove-shaped bearing-retaining groove accommodating the bearing, and a circumferential-groove-shaped sealing-means-retaining groove accommodating the sealing means and formed inside thereof in the axial direction in succession.

In the gear pump device for rubber extrusion according to the present invention, it is preferable that the sealing means has a ring-shaped holder concentrically inserted in the sealing-means-retaining groove, the inner peripheral surface of the holder is provided in its inside in the axial direction with a circumferential-groove-shaped seal-ring-retaining groove accommodating the seal ring, and an inner end in the axial direction, of the seal-ring-retaining groove opens in the inside surface in the axial direction, of the holder.

Effect of the Invention

In the present invention, the bushing ring inserted in the gear-housing bore incorporates the bearing rotatably supporting the support-shaft portion of each gear, and the sealing means sealing between it and the outer peripheral surface of the support-shaft portion. And the sealing ring disposed in the sealing means is formed from the rubber elastic body whose cross section is ]-shaped in which the side wall portion connects between the axially outer end of the first lip portion contacting with the outer peripheral surface of the support-shaft portion, and the axially outer end of the second lip portion disposed radially outside thereof.

Such seal ring is provided therein with a hole portion which is surrounded by the first and second lip portions and the side wall portion and which opens toward a pump chamber. Therefore, if a portion of the rubber existing in the pump chamber flows into the hole portion, then by the pressure of the rubber, the first lip portion is strongly pressed against the outer peripheral surface of the support-shaft portion, and reliably seals between it and the support-shaft portion. This prevents rubber scorch from occurring at the support-shaft portion for a long term, which makes it possible to prolong the maintenance interval.

Moreover, as the support-shaft portion is rotatably supported by the bearing, in cooperation with the sealing ring, the operation with low torque is possible, which make it possible to suppress failure of the drive system.

MODE FOR CARRYING OUT THE INVENTION

Hereinafter, embodiments of the present invention will be described in detail.

Figure 1:
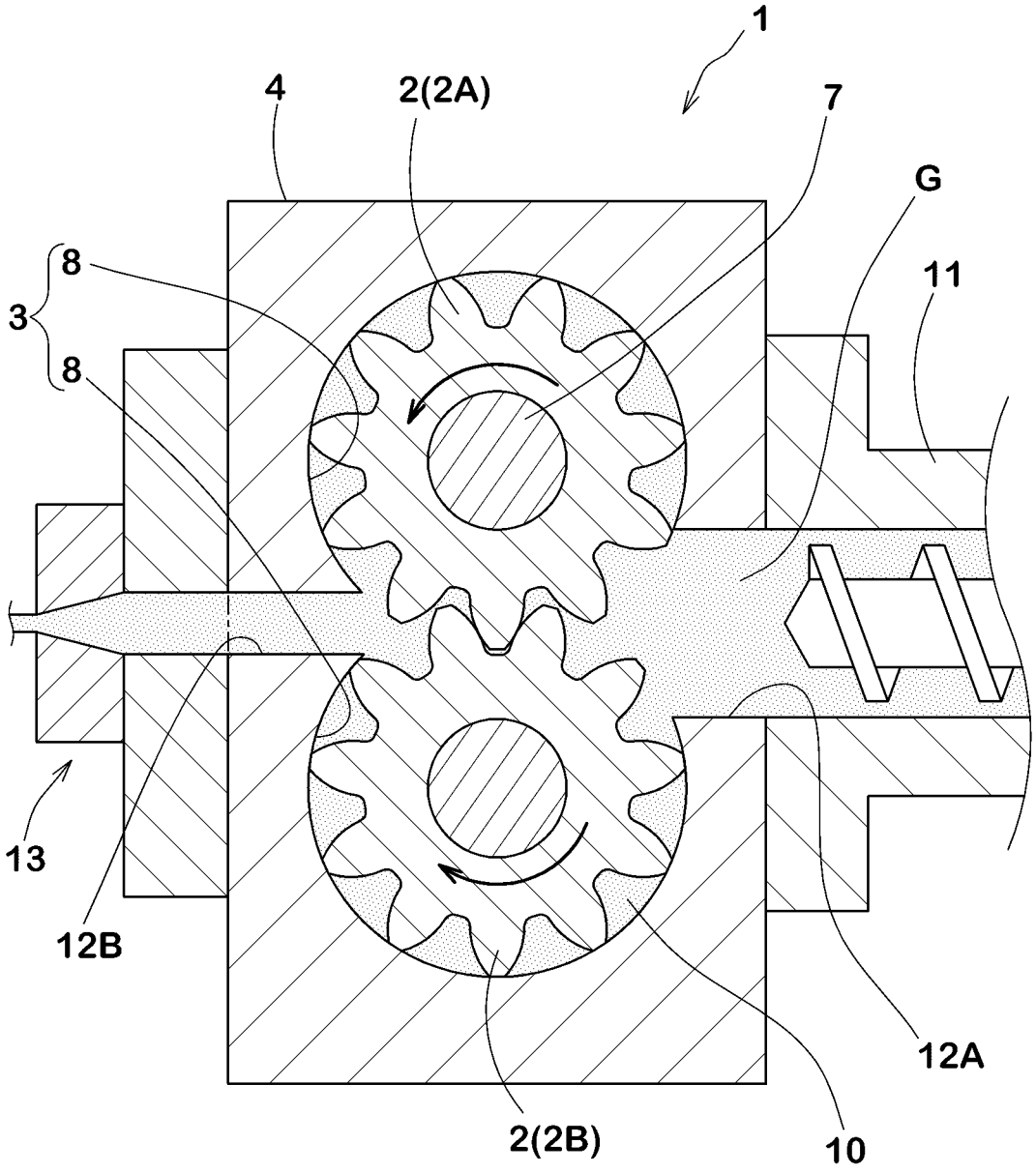
FIG. 1 A cross-sectional view perpendicular to the axial direction which shows an embodiment of the gear pump device for rubber extrusion of the present invention.
Figure 2:
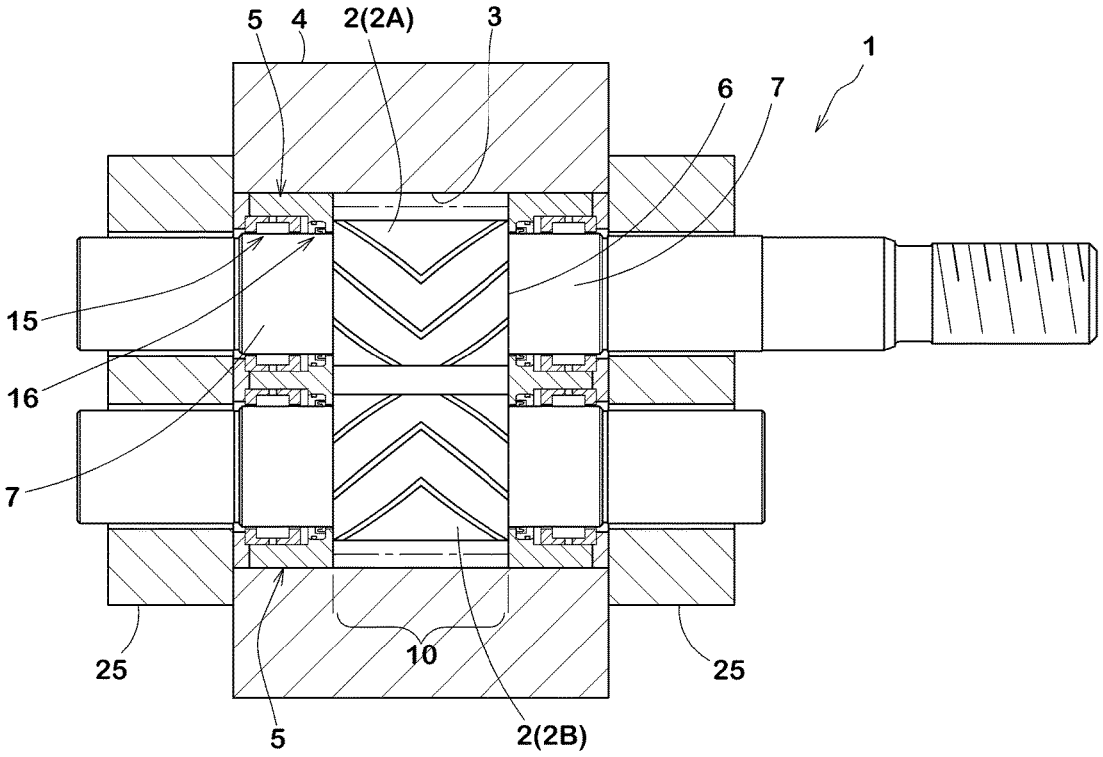
FIG. 2 A cross-sectional view taken along the axial direction of the gear pump device in FIG. 1.
Figure 3:
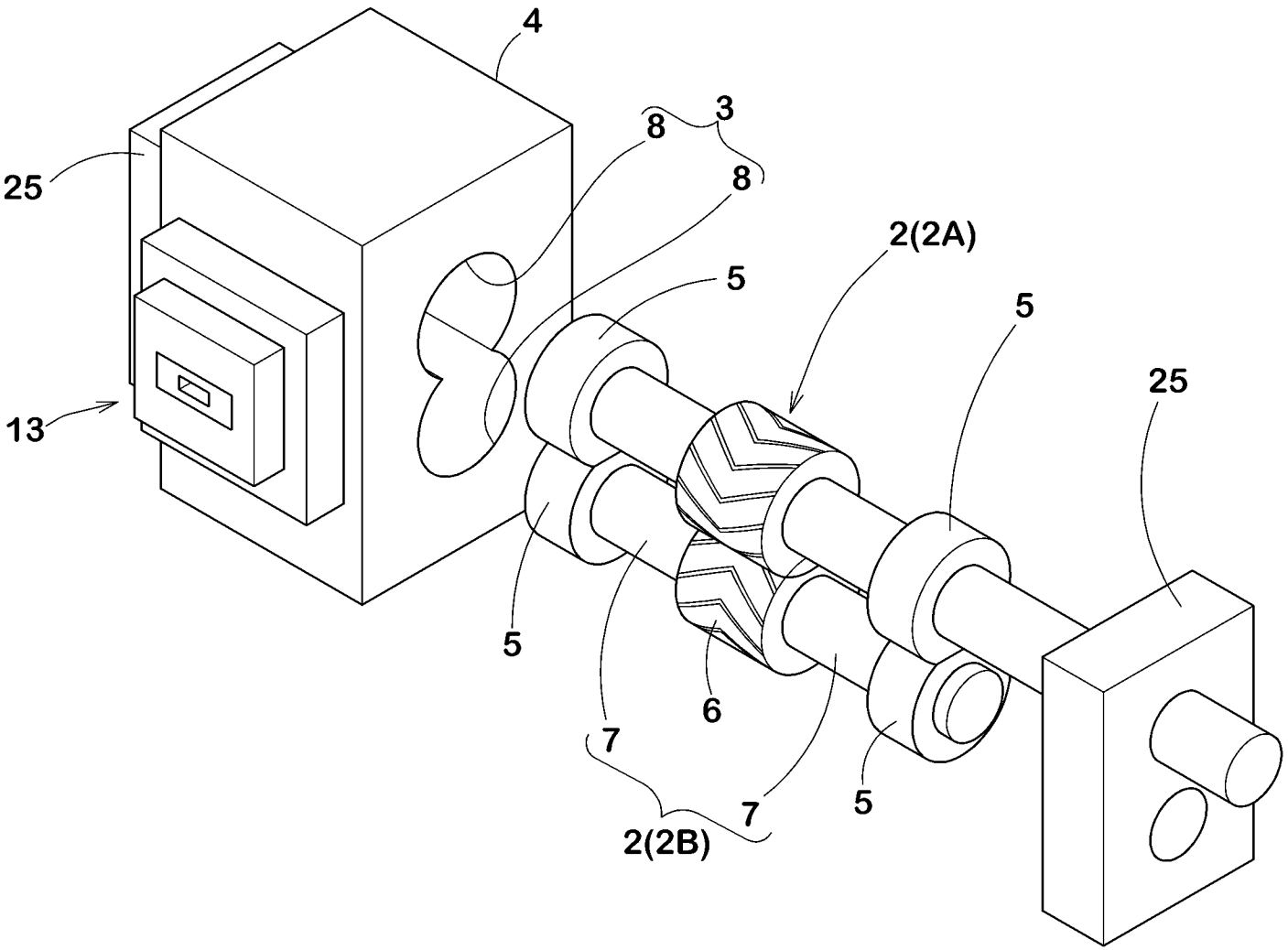
FIG. 3 An exploded perspective view schematically showing the gear pump device in FIG. 1.

As shown in FIGS. 1-3, a gear pump device 1 for rubber extrusion in the present embodiment (hereinafter simply referred to as "gear pump device 1") has a pair of gears 2, 2 engaged with each other, a housing 4 having a gear-housing bore 3 accommodating a pair of the gears 2, 2, and a bushing ring 5 inserted in the gear-housing bore 3.

The paired gears 2, 2 are, for example, constituted by a driving gear 2A coupled with a motor and, and a driven gear 2B rotated by the gear 2A.

Each of the gears 2A, 2B has a gear portion 6 with tooth spaces, and a support-shaft portion 7 concentrically extending toward both sides in the axial direction from the gear portion 6.

Inside the housing 4, the gear-housing bore 3 penetrating therethrough in the axial direction is provided. The gear-housing bore 3 has a gourd shape formed by connecting two arcuate portions 8 which are concentric with the respective gears 2A, 2B and, for example, which make sliding contact with the gear portions 6 of the respective gears 2A, 2B.

The region between the bushing rings 5, 5 in the gear-housing bore 3 constitutes a pump chamber 10 (shown in FIG. 2).

As shown in FIG. 1, flow paths 12A, 12B are formed in the housing 4. The flow path 12A takes rubber G, for example coming from a rubber extruder 11, into the pump chamber 10. The flow path 12B pushes the rubber G out of the pump chamber 10 toward a nozzle 13. The flow paths 12A, 12B extend in the direction perpendicular to the axial direction, and communicate with the pump chamber 10 at the connecting position between the arcuate portions 8, 8.

As shown in FIGS. 2 and 3, the bushing rings 5 are inserted in the gear-housing bore 3 at both end portions in the axial direction, respectively.

The bushing ring 5 incorporates a bearing 15 rotatably supporting the support-shaft portion 7, and a sealing means 16 disposed inside in the axial direction, of the bearing 15. Here, the "inside" in the axial direction means the direction toward the center of the axial direction width of the pump chamber 10.

Figure 4:
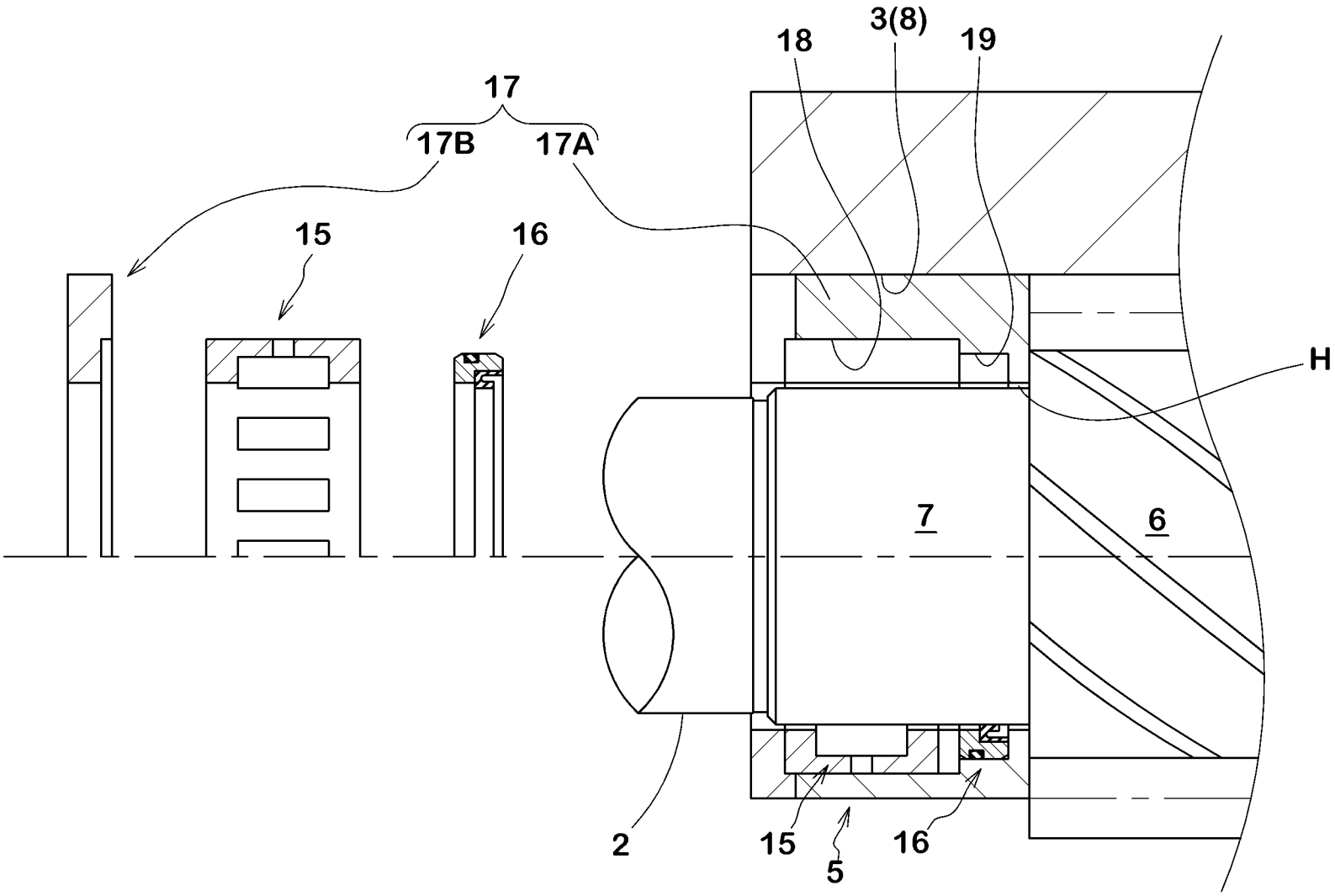
FIG. 4 A cross-sectional view taken along the axial direction which shows the bushing ring.

Specifically, as shown in FIG. 4, the bushing ring 5 includes a ring-shaped bushing base portion 17 concentrically inserted in the gear-housing bore 3 (strictly in an arcuate portion 8).

In the inner peripheral surface of the bushing base portion 17, a circumferential-groove-shaped bearing-retaining groove 18 accommodating the bearing 15, and a circumferential-groove-shaped sealing-means-retaining groove 19 accommodating the sealing means 16 are formed in succession in the axial direction.

Between the inner peripheral surface of the bushing base portion 17 and the outer peripheral surface of the support-shaft portion 7, a gap H is formed.

In FIG. 4, the state before mounting of the bearing 15 and sealing means 16 is shown on the upper side of the axis of the gear 2, and the state after mounting is shown on the lower side of the axis.

The sealing-means-retaining groove 19 is smaller in diameter than the bearing-retaining groove 18.

The bushing base portion 17 can be divided into axially inner and outer split pieces 17A, 17B at a position of the outer end in the axial direction, of the bearing-retaining groove 18. Thus, from the side of the outer end of the bushing ring 5, the sealing means 16 and the bearing 15 can be inserted sequentially and mounted. Incidentally, the split pieces 17A, 17B are united with each other by screws or the like.

As the bearing 15, a needle bearing can be suitably employed.

The sealing means 16 seals between it and the outer peripheral surface of the support-shaft portion 7.

Figure 5:
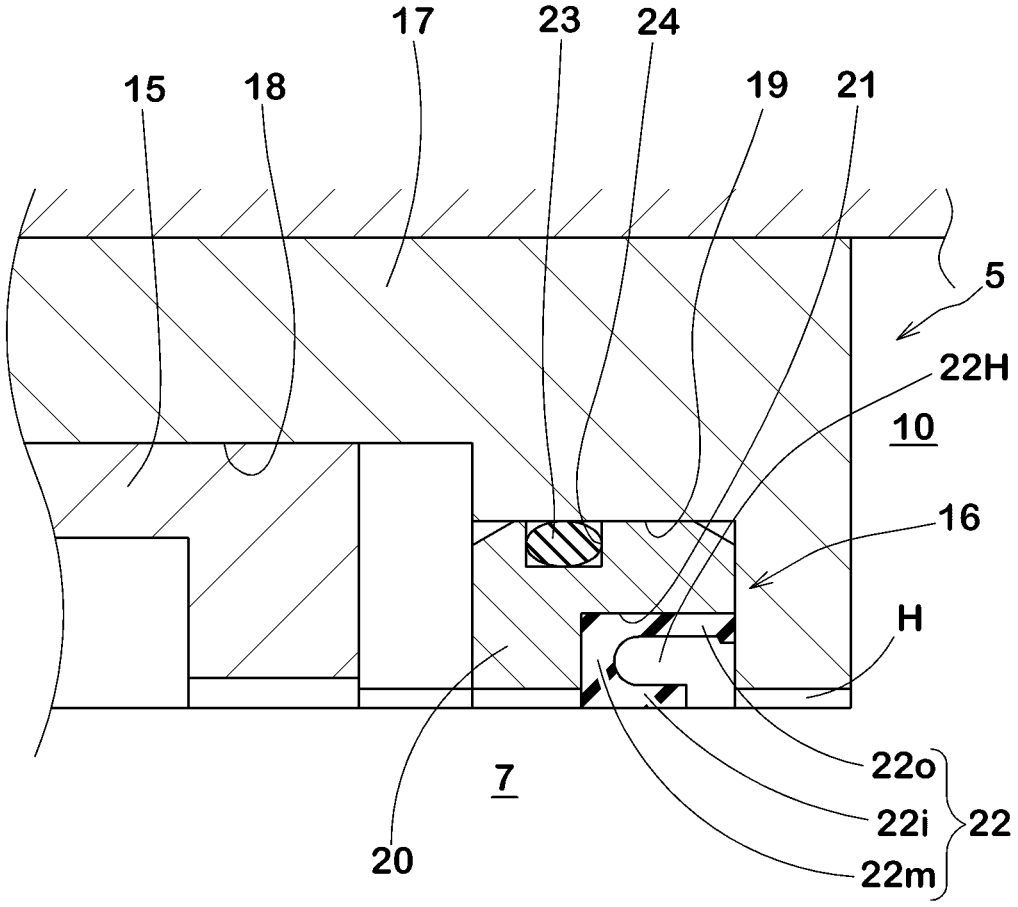
FIG. 5 A cross-sectional view taken along the axial direction which shows the sealing means.
Figure 6:
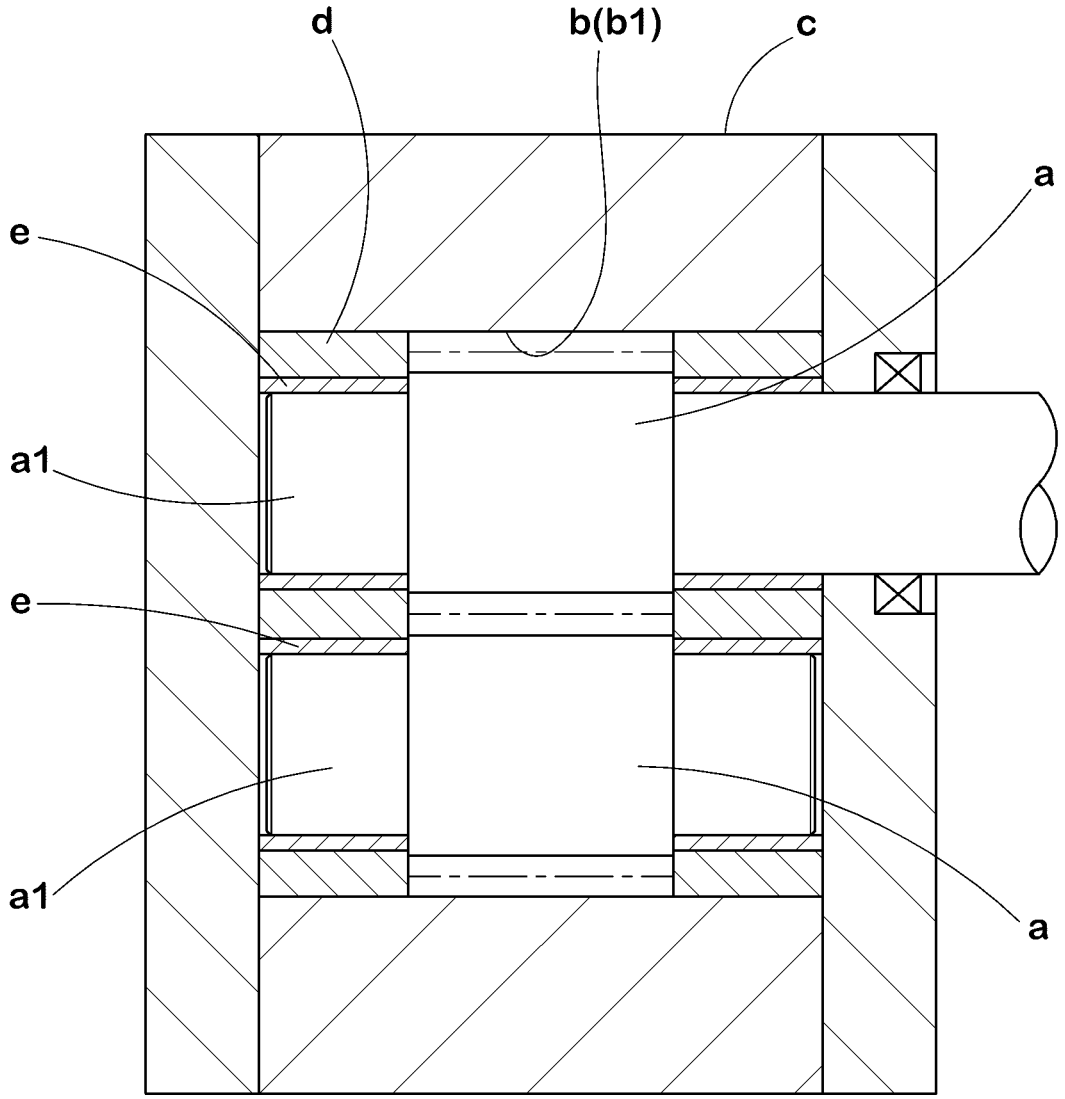
FIG. 6 A cross-sectional view taken along the axial direction which shows a example of a conventional gear pump device.

As shown in FIG. 5, the sealing means 16 in the present embodiment has a holder 20 and a sealing ring 22 formed from a rubber elastic body.

The holder 20 is ring-shaped, and concentrically inserted in the sealing-means-retaining groove 19.

The sealing ring 22 is accommodated in a seal-ring-retaining groove 21 which is formed in the inner peripheral surface of the holder 20.

In the outer peripheral surface of the holder 20, there is formed a circumferential groove 24 for mounting an O-ring 23 sealing between it and the inner peripheral surface of the sealing-means-retaining groove 19.

The seal-ring-retaining groove 21 is configured in the form of a circumferential groove formed in an inside in the axial direction of the inner peripheral surface of the holder 20. The inner end in the axial direction, of the seal-ring-retaining groove 21 is opened in the inside surface in the axial direction, of the holder 20.

The seal ring 22 has a cylindrical first lip portion 22*i* contacting with the outer peripheral surface of the support-shaft portion 7, a cylindrical second lip portion 22*o* disposed outside thereof in the radial direction, and a sidewall portion 22*m* connecting between outer ends in the axial direction, of the first and second lip portions 22*i*, 22*o* so as to have a ]-shaped cross section. Therefore, the sealing ring 22 is provided therein with a hole portion 22H which is surrounded by the first and second lip portions 22*i*, 22*o* and the side wall portion 22*m* and which is opened toward the pump chamber 10.

Thus, when a portion of the rubber G existing in the pump chamber 10 flows into the hole portion 22H through the gap H, the first lip portion 22*i* is strongly pressed against the outer peripheral surface of the support-shaft portion 7 by the pressure of the rubber G. This can reliably seal between it and the shaft portion 7, and suppress the occurrence of rubber scorch at the support-shaft portion 7 for a long term, which makes it possible to prolong the maintenance interval. Further, as the support-shaft portion 7 is rotatably supported by the bearing 15, in cooperation with the sealing ring 22, the operation at low torque is possible, which make it possible to suppress failure of the drive system.

As to the sealing ring 22, it is desirable that it has heat resistance and detachability from unvulcanized rubber, and fluorine-based resins can be employed favorably.

The fluorine-based resins include fully fluorinated resin which is polytetrafluoroethylene (tetrafluorinated resin, abbreviation: PTFE)

partially fluorinated resins which are polychlorotrifluoroethylene (trifluorinated resins, abbreviations: PCTFE, CTFE), polyvinylidene fluoride (abbreviations: PVDF), polyvinyl fluoride (abbreviation: PVF)

fluorinated resin copolymers which are perfluoroalkoxy fluorocarbon resin (abbreviation: PFA), tetrafluoroethylene-hexafluoropropylene copolymer (abbreviation: FEP), ethylene tetrafluoroethylene copolymer (abbreviation: ETFE), ethylene-chlorotrifluoroethylene copolymer (abbreviation: ECTFE) and the like.

Further, side plates 25 (shown in FIGS. 2 and 3) are attached onto the both sides of the housing 4 to prevent the bushing rings 5 from coming off.

While detailed description has been made of an especially preferable embodiment of the present invention, the present invention can be embodied in various forms without being limited to the illustrated embodiment.

DESCRIPTION OF THE REFERENCE CHARACTERS

1 gear pump device for rubber extrusion
2, 2A, 2B gear
3 gear-housing bore
4 housing
5 bushing ring
6 gear portion
7 support-shaft portion
15 bearing
16 sealing means
17 bushing base portion
18 bearing-retaining groove
19 sealing-means-retaining groove
20 holder
21 seal-ring-retaining groove
22 sealing ring

The invention claimed is:

1. A gear pump device for rubber extrusion, which has a pair of gears engaged with each other, a housing having a gear-housing bore housing a pair of the gears, and a bushing ring inserted in the gear-housing bore at end portions thereof in the axial direction, and which is characterized in that the gear has a gear portion and a shaft portion concentrically extending from the gear portion toward both sides in the axial direction, the bushing ring has a bearing and a sealing means built-in, the bearing rotatably supporting the support-shaft portion, and the sealing means disposed inward of the bearing in the axial direction and sealing between it and the outer peripheral surface of the support-shaft portion, and the sealing means includes a sealing ring which is formed from a rubber elastic body whose cross section is ]-shaped and which has a cylindrical first lip portion contacting with the outer peripheral surface of the support-shaft portion, a cylindrical second lip portion disposed outside thereof in the radial direction, and a side wall portion connecting between axially outer ends of the first and second lip portions.

2. The gear pump device for rubber extrusion as set forth in claim 1, which is characterized in that the bushing ring has a ring-shaped bushing base portion concentrically inserted in the gear-housing bore, and the inner peripheral surface of the bushing base portion has a circumferential-groove-shaped bearing-retaining groove accommodating the bearing, and a circumferential-groove-shaped sealing-means-retaining groove accommodating the sealing means and formed inside thereof in the axial direction in succession.

3. The gear pump device for rubber extrusion as set forth in claim 2, which is characterized in that the sealing means has a ring-shaped holder concentrically inserted in the sealing-means-retaining groove, the inner peripheral surface of the holder is provided in its inside in the axial direction with a circumferential-groove-shaped seal-ring-retaining groove accommodating the seal ring, and an inner end in the axial direction, of the seal-ring-retaining groove opens in the inside surface in the axial direction, of the holder.

* * * * *